US006042112A

United States Patent [19]

Izumi

[11] Patent Number: 6,042,112

[45] Date of Patent: Mar. 28, 2000

[54] PAPER CONVEYER FOR IMAGE RECORDING APPARATUS

[75] Inventor: Naoyuki Izumi, Niigata, Japan

[73] Assignee: NEC Corporaiton, Japan

[21] Appl. No.: 08/971,232

[22] Filed: Nov. 15, 1997

[30] Foreign Application Priority Data

Nov. 20, 1996 [JP] Japan ..... 8-308797

[51] Int. Cl.[7] ..... B65H 5/06

[52] U.S. Cl. ..... 271/273; 271/272; 400/637

[58] Field of Search ..... 271/272, 273; 226/190, 194; 400/637

[56] References Cited

U.S. PATENT DOCUMENTS

| | | | |
|---|---|---|---|
| 2,974,952 | 3/1961 | Zeuthen | 271/273 |
| 4,491,887 | 1/1985 | Sato . | |
| 5,221,035 | 6/1993 | Suzuki et al. . | |
| 5,351,945 | 10/1994 | Asakawa et al. | 271/273 |

FOREIGN PATENT DOCUMENTS

| | | | |
|---|---|---|---|
| 2-99369 | 4/1990 | Japan . | |
| 404365733 | 12/1992 | Japan | 271/273 |
| 405162885 | 6/1993 | Japan | 271/272 |
| 1471657 | 4/1977 | United Kingdom | 271/272 |

OTHER PUBLICATIONS

Patent Abstracts of Japan, JP 63 280670A, OKI Electric Ind. Co. Ltd., Nov. 17, 1988; and.

Patent Abstracts of Japan, JP 04 288268A, Canon Inc., Oct. 13, 1992.

*Primary Examiner*—H. Grant Skaggs
*Attorney, Agent, or Firm*—Ostrolenk, Faber, Gerb & Soffen, LLP

[57] ABSTRACT

A guide plate is arranged in spaced parallel relation with a recording head. A pinch roller and a paper conveyer roller are arranged upstream of the guide plate with respect to a paper feeding direction. The pinch roller takes an entrance position to provide a state wherein the rollers most easily catch paper sheet. After the rollers have caught the paper sheet, the pinch roller is displaced to take an exit position to provide a state wherein the roller deflect the paper sheet towards the guide plate.

7 Claims, 1 Drawing Sheet

PAPER CONVEYER FOR IMAGE RECORDING APPARATUS

BACKGROUND OF THE INVENTION

1. Field of the Invention

The present invention relates to an image recording apparatus, and more particularly to a paper conveyer for conveying paper sheets through a sheet carrier path within an image recording apparatus.

2. Description of the Related Art

Generally, it is the common practice to use a pair of rollers, namely, a paper conveying roller and a pinch roller, to convey paper sheets onto a guide plate that forms a part of a paper carrier path within an image recording apparatus. The guide plate is arranged in a spaced parallel relationship with respect to a recording head. The rollers rotate in opposite directions to catch the leading edge of paper sheet and urge the sheet against the guide plate. It is indispensable to urge paper against the guide plate to keep it extending flatly over the surface of the guide plate, thus insuring high quality forming of an image onto the paper. To accomplish this mission, it is known to arrange an axis of rotation of the pinch roller as displaced from a plane, including an axis of rotation of the conveying roller, normal to a paper feeding direction. The pinch roller axis is displaced from the normal plane in such a direction as to urge paper against the guide plate. If an amount of such displacement is increased sufficiently, the rollers fail to catch paper sheet in a satisfactory manner.

An object of the present invention is to provide a solution to this problem.

SUMMARY OF THE INVENTION

According to the present invention, there is provided a paper conveyer for an image forming apparatus having a guide plate in spaced relation with respect to a recording head. The conveyor includes a paper conveying roller having a first axis of rotation and a roller support carrying a pinch roller. The pinch roller has a second axis of rotation. The roller support is displaceable between a first position in which the pinch roller takes an entrance position and a second position in which the pinch roller takes an exit position.

DESCRIPTION OF THE PREFERRED EMBODIMENT

Figure 1:
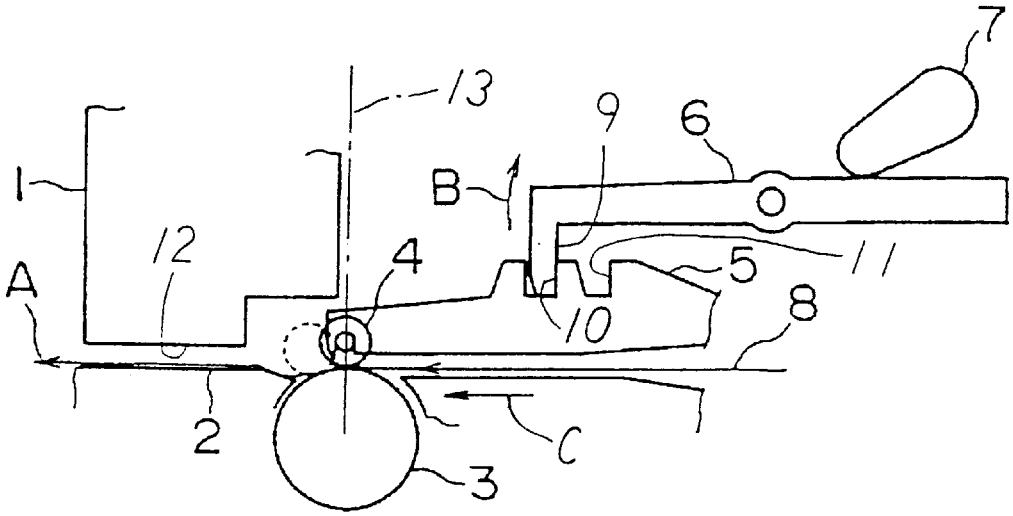
FIG. 1 is a diagram of a portion of an image recording apparatus, illustrating a paper conveyer according to the present invention in a first or home position for performing a first stage operation of catching paper sheets.
Figure 2:
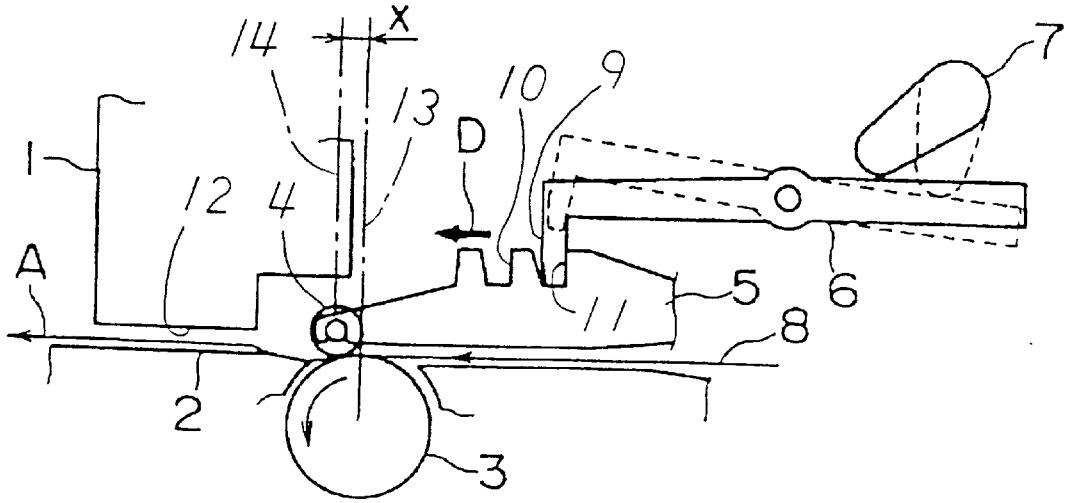
FIG. 2 is a diagram illustrating the paper conveyer in a second position for performing a second stage operation of urging paper against a guide plate.

Referring to FIG. 1, an image recording apparatus includes a recording head 1 and a guide plate 2 arranged in a known manner. In this embodiment, the image recording apparatus is an ink-jet printer and the recording head 1 is an ink-jet printhead. The guide plate 2 is arranged in a parallel spaced relationship with respect to the recording head 1 to guide paper sheets 8 in a predetermined direction as indicated by an arrow A. A paper conveyer includes a paper conveying roller 3 and a pinch roller 4. The roller 3 is arranged upstream of the guide plate 2 with respect to a flow of paper sheets 8 conveyed through a paper carrier path within the image recording apparatus. The guide plate 2 forming a part of the paper carrier path. The roller 3 has a fixed axis for rotation thereabout. The pinch roller 4 is supported by a roller support 5 for rotation about a pinch roller axis that is displaceable. The roller support 5 is displaceable from a first or home position as illustrated in FIG. 1 to a second position as illustrated in FIG. 2. To hold the roller support 5 in the first or second position, a lock lever 6 is pivoted. A rotary cam 7 actuates the lock lever 6 between a lock position as illustrated in FIG. 1 and a release position as illustrated by the broken line in FIG. 2. At one end thereof, the lock lever 6 has a lock tooth 9. The lock tooth 9 is adapted to engage a first notch 10 to hold the roller support 5 in the home position of FIG. 1 or a second notch 11 to hold the roller support 5 in the second position of FIG. 2. The roller support 5 is formed with the notches 10 and 11.

Let it be assumed that paper sheet 8 is supplied to the rollers 3 and 4 in a paper feeding direction as indicated by arrow C (see FIG. 1). In the home position as illustrated in FIG. 1, the roller support 5 keeps the pinch roller 4 in an entrance position on the roller 3 so as to provide a state wherein the leading edge of paper sheet 8 is most easily caught between the rollers 3 and 4. In this embodiment, viewing in FIG. 1, the axis of rotation of the roller 4 is disposed vertically above the axis of rotation of the roller 3. In other words, the axis of the roller 4 is disposed within a plane 13, including the axis of the roller 3, normal to the paper feeding direction C.

In the second position as illustrated in FIG. 2, the roller support 5 keeps the roller 4 in an exit position on the roller 3 so as to provide a state wherein, as it leaves the rollers, paper 8 is deflected towards the surface of the guide plate 2. This arrangement insures that the paper sheet 8 is received by the guide plate 2 in an appropriate spaced parallel relation with respect to a nozzle surface 12 of the recording head 1 without causing any partial separation of the paper 8 from the surface of the guide plate 2. In this embodiment, viewing in FIG. 2, the axis of the roller 4 is displaced towards the guide plate 2 from the plane 13, including the axis of the roller 3, normal to the paper feeding direction C by a predetermined amount. This amount may be expressed in terms of a distance X between the normal plane 13 including the axis of the roller 3 and a normal plane 14 including the axis of the roller 4. Preferably, this distance X ranges from 10 mm to 20 mm.

The lock lever 6 is spring biased counterclockwise as viewed in FIGS. 1 and 2. Viewing in FIG. 2, rotating the cam 7 counterclockwise towards a position as illustrated by the broken line causes the lock lever 6 to pivot clockwise from a lock position as illustrated by the fully drawn line to a release position as illustrated by the broken line. This clockwise pivot motion causes the lock tooth 9 to disengage from the notch 10 or 11 thereby to allow the roller support 5 to displace.

A pivot pin and an elongate hole receiving the pivot pin cooperate with each other to define limits of movement of the roller support 5. The pivot pin may be integrally formed on the roller support 5 and the elongate hole may be formed through a frame of the image recording apparatus. The home position of the roller support 5 is defined by engagement of the pivot pin with one end of the elongate hole. The second position of the roller support 5 is defined by engagement of the pivot pin with the opposite end of the elongate hole. The pivot pin and elongate hole arrangement permits the weight of the roller support 5 to keep the roller 4 in frictional contact with the roller 3.

The roller 4 is reluctant to rotate about its axis. Thus, counterclockwise rotation of the roller 3 causes the axis of the roller 4 to orbit about the axis of the roller 3 from the entrance position (FIG. 1) to the exit position (FIG. 2) to move the roller support 5 from the home position to the second position. Subsequently, clockwise rotation of the roller 3 causes the axis of the roller 4 to orbit from the exit position to the entrance position. With the axis of the roller 4 held in the entrance or exit position by the lock lever 6, rotation of the roller 3 causes the roller 4 to rotate about its axis. With the axis of the roller 4 held in the entrance position (see FIG. 1), counterclockwise rotation of the roller 4 causes the roller to rotate clockwise, thus facilitating trapping of paper sheet 8 by the rollers 3 and 4. With the axis of the roller 4 held in the exit position (see FIG. 2), counterclockwise rotation of the roller 3 causes the roller 4 to rotate clockwise, thus facilitating discharging of paper sheet 8 by the rollers 3 and 4.

The image recording apparatus includes a system for detecting presence of paper sheet 8 within the rollers 3 and 4. The detecting system employs a sensor that uses a first beam of light passing through a portion of the paper carrier path immediately downstream of the plane 13 and a second beam of light passing through a portion of the paper carrier path immediately downstream of the plane 14. When the first beam of light is interrupted by the passage of paper sheet 8, the detecting system generates a first pulse. When the second beam of light is interrupted by the passage of paper sheet 8, the detecting system generates a second pulse. The leading edge of the first pulse is indicative of first moment at which the leading end of paper sheet 8 has passed through the plane 13. The trailing edge of the second pulse is indicative of second moment at which the trailing end of the paper sheet 8 has passed through the plane 14. The outputs of the detecting system are fed to a controller, not shown. The controller inputs information from the outputs of the detecting system as to the first moment when paper sheet 8 has entered the rollers 3 and 4 and the second moment when the paper sheet 8 has left the rollers 3 and 4.

At the first moment, the controller outputs a cam drive signal to a driver for the cam 7. Upon receiving the cam drive signal, the cam driver rotates the cam 7 counterclockwise from the position shown in FIG. 1 to the position drawn by the broken line in FIG. 2 to disengage the lock tooth 9 from the notch 10 of the roller support 5. After a temporal stay in the position drawn by the broken line in FIG. 2, the cam 7 returns to take the position drawn by the fully drawn line in FIG. 1 owing to the action of the spring biasing the lock lever 6. As the roller 3 rotates counterclockwise to urge the roller 4 and the roller support 5 to move toward the guide plate 2, the roller support 5 moves toward the guide plate 2 immediately after the disengagement of the lock tooth 9 out of the notch 10. Once the lock tooth 9 disengages from the notch 10, it fails to align with the notch 10 so that even if the lock lever 6 returns toward the position as shown in FIG. 1, the lock tooth 9 will not enter the notch 10. However, the lock tooth 9 engages the notch 11 when the roller 4 and the roller support 5 take the position as illustrated in FIG. 2.

At the second moment when paper sheet 8 has left the roller 3 and 4, the controller outputs a cam drive signal to the cam driver and a roller reverse drive signal to a driver for the paper conveying roller 3. Upon receiving the cam drive signal, the cam driver rotates the cam 7 counterclockwise to the position drawn by the broken line in FIG. 2 to disengage the lock tooth 9 from the notch 11 of the roller support 5. Upon receiving the roller reverse drive signal, the paper conveying roller driver rotates the roller 3 clockwise for a predetermined period of time, thus urging the roller 4 and roller support 5 for movement toward the position as illustrated in FIG. 1. When the roller 4 and the roller support 5 take the position as illustrated in FIG. 1, the lock tooth 9 engages the notch 10. Upon elapse of the predetermined period of time, the roller 3 stops rotating clockwise.

What is claimed is:

1. A paper conveyer for an image forming apparatus having a guide plate in spaced relation with respect to a recording head, the paper conveyer delivering paper to the guide plate, the conveyer comprising:

a paper conveying roller having a first axis of rotation and rotating in a paper feeding direction; and a roller support carrying a pinch roller on said paper conveying roller, said pinch roller having a second axis of rotation and rotating in the paper feeding direction;

said roller support being displaceable between a first position in which said second axis of rotation and said first axis of rotation are disposed in a first plane normal to the paper feeding direction and a second position in which said second axis of rotation is disposed in a second plane normal to the paper feeding direction and displaced toward the guide plate from said first plane.

2. A paper conveyer as claimed in claim 1, wherein said second plane is spaced from said first plane by a distance ranging from 10 mm to 20 mm.

3. A paper conveyer as claimed in claim 1, wherein, in said first position of said roller support said pinch roller and said paper conveying roller provide a state wherein paper sheet is easily caught between said pinch and paper conveying rollers.

4. A paper conveyer as claimed in claim 3, wherein, in said second position of said roller support said pinch roller and said paper conveying roller provide a state wherein, as a paper sheet leaves said pinch and paper conveying rollers, the paper sheet is deflected towards the surface of the guide plate.

5. A paper conveyer as claimed in claim 4, wherein the guide plate is arranged to guide paper sheet discharged by said pinch and paper conveying rollers in a predetermined direction.

6. A paper conveyer for an image forming apparatus having a guide plate in spaced relation with respect to a recording head, the conveyer comprising:

a paper conveying roller having a first axis of rotation and rotating in a paper feeding direction; and a roller support carrying a pinch roller on said paper conveying roller, said pinch roller having a second axis of rotation and rotating in the paper feeding direction;

said roller support being displaceable between a first position in which said second axis of rotation and said first axis of rotation are disposed in a first plane normal to the paper feeding direction and a second position in which said second axis of rotation is disposed in a second plane normal to the paper feeding direction and displaced toward the guide plate from said first plane;

a lock lever arranged to cooperate with said roller support to hold said roller support in any one of said first and second positions thereof; and a cam arranged to actuate said lock lever.

7. A paper conveyer for an image forming apparatus having a guide plate in spaced relation with respect to a recording head, the conveyer comprising:

a paper conveying roller having a first axis of rotation;

a roller support carrying a pinch roller on said paper conveying roller, said pinch roller having a second axis of rotation, wherein said roller support is formed with a first notch and a second notch;

a lock lever arranged to cooperate with said roller support to hold said roller support in any one of said first and second positions thereof; and a cam arranged to actuate said lock lever;

wherein said lock lever engages said first notch in said roller support to hold said roller support in said first position, and wherein said lock lever engages said second notch in said roller support to hold said roller support in said second position.

* * * * *